US009206606B2

(12) United States Patent
Jaks

(10) Patent No.: US 9,206,606 B2
(45) Date of Patent: Dec. 8, 2015

(54) INSULATED STANDING SEAM ROOF PANEL

(71) Applicant: GREEN SPAN PROFILES, Waller, TX (US)

(72) Inventor: Brian N. Jaks, Waller, TX (US)

(73) Assignee: Green Span Profiles, Waller, TX (US)

( * ) Notice: Subject to any disclaimer, the term of this patent is extended or adjusted under 35 U.S.C. 154(b) by 0 days.

(21) Appl. No.: 14/452,207

(22) Filed: Aug. 5, 2014

(65) Prior Publication Data

US 2015/0040502 A1 Feb. 12, 2015

Related U.S. Application Data

(60) Provisional application No. 61/862,669, filed on Aug. 6, 2013.

(51) Int. Cl.

| | |
|---|---|
| ***E04B 7/00*** | (2006.01) |
| ***E04D 3/362*** | (2006.01) |
| *E04D 3/36* | (2006.01) |
| *E04D 3/35* | (2006.01) |
| *E04D 3/366* | (2006.01) |

(52) U.S. Cl.

CPC ..... *E04D 3/362* (2013.01); *E04D 3/352* (2013.01); *E04D 3/36* (2013.01); *E04D 3/366* (2013.01)

(58) Field of Classification Search

CPC ..... E04D 3/36; E04D 3/352; E04D 3/362
USPC ..... 52/309.4, 395, 459, 463, 465
See application file for complete search history.

(56) References Cited

U.S. PATENT DOCUMENTS

| | | | | | |
|---|---|---|---|---|---|
| 3,555,758 | A * | 1/1971 | Schroter | 52/309.9 |
| 3,708,943 | A * | 1/1973 | Thomas et al. | 52/309.8 |
| 4,135,342 | A * | 1/1979 | Cotter | 52/461 |
| 4,177,615 | A * | 12/1979 | Anderson | 52/478 |
| 4,366,656 | A * | 1/1983 | Simpson | 52/395 |
| 4,476,658 | A * | 10/1984 | Johnstone | 52/395 |
| 4,649,684 | A * | 3/1987 | Petree et al. | 52/395 |
| 5,134,825 | A * | 8/1992 | Berridge | 52/520 |
| 5,737,892 | A * | 4/1998 | Greenberg | 52/469 |
| 6,324,806 | B1 * | 12/2001 | Rebman | 52/465 |
| 6,354,045 | B1 * | 3/2002 | Boone et al. | 52/95 |
| 6,536,173 | B2 * | 3/2003 | Rebman | 52/465 |
| 7,441,379 | B2 * | 10/2008 | Konstantin | 52/200 |
| 7,661,234 | B2 * | 2/2010 | Voegele, Jr. | 52/466 |
| 7,748,186 | B2 * | 7/2010 | Voegele, Jr. | 52/466 |
| 8,590,235 | B2 * | 11/2013 | Resso et al. | 52/302.1 |
| 8,713,864 | B1 * | 5/2014 | Smith, Jr. | 52/200 |
| 8,793,951 | B2 * | 8/2014 | Resso et al. | 52/302.1 |

OTHER PUBLICATIONS

Article, "CFR Insulated Metal Roof Panel," Metl-Span: Pioneering Insulated Metal Panel Technology: dated 2012 (1 pg.).

(Continued)

*Primary Examiner* — Charles A Fox
*Assistant Examiner* — James Buckle, Jr.
(74) *Attorney, Agent, or Firm* — Derek V. Forinash; Porter Hedges LLP

(57) ABSTRACT

A roof panel includes a fascia plate having a pair of vertical legs extending from opposite edges of the fascia plate with a receptacle formed into an upper end of each of the pair of vertical legs so that the receptacle opens outwardly relative to the fascia plate. An insulating foam is bonded to the fascia plate and to a liner plate that has a tongue and groove formed on opposite edges of the liner plate.

13 Claims, 4 Drawing Sheets

(56) References Cited

OTHER PUBLICATIONS

Web-Page, "Insulated BattenLok," Eco-Ficient, Insulated Metal Panels; www.ecoficientseries.com (1 pg.).
Article, "SR2 standing Seam Roof Panel," AWIP; California; dated 2012 (1 pg.).
Article, "King Zip; Insulated Standing Seam Roof Panel System," Kingspan; California; Issue 1: dated Jul. 2011 (2 pgs.).
Web-Page, "Setting the New Standard; 138T and 238T Symmetrical Panel System," McElroy Metal; www.mcelroymetal.com (4 pgs.).

* cited by examiner

INSULATED STANDING SEAM ROOF PANEL

CROSS-REFERENCE TO RELATED APPLICATIONS

This application claims the benefit under 35 U.S.C. §119 (e) of U.S. Provisional Patent Application No. 61/862,669 filed Aug. 6, 2013, the disclosure of which is hereby incorporated herein by reference.

BACKGROUND

This disclosure relates generally to methods and apparatus for providing prefabricated insulated roofing panels. More specifically, this disclosure relates to methods and apparatus for prefabricated insulated roof panels that allow for simplified installation methods and provide improved watertight seams.

Metal roofs have been in use for many years in commercial and industrial construction. One type of prefabricated metal roof system is a standing seam roof system. Standing seam roof systems generally include a plurality of pre-formed metal panels that have a vertically extending male flange that abuts a female flange on an adjacent panel. Once the panels are placed on a structure, the abutting flanges are mechanically interlocked by mechanical fasteners, deforming the flanges, or through other methods.

In certain applications, the prefabricated roof panels may be constructed with a layer of insulation coupled to the preformed metal panel. These insulated roof panels often include a second lower metal layer on the underside of the insulation. In many instances, this lower metal panel includes an interlocking feature formed on opposite sides of a panel so that when assembled, two adjacent panels are interlocked both by the standing seam flanges and by the interlocking features of the lower metal panel. In many existing products, interlocking both of these features can be problematic given the weight of a roof panel and the need for simultaneous alignment of both interlocking features.

Thus, there is a continuing need in the art for methods and apparatus for prefabricated roof panels that overcome these and other limitations of the art.

BRIEF SUMMARY OF THE DISCLOSURE

A roof panel includes a fascia plate having a pair of vertical legs extending from opposite edges of the fascia plate. A receptacle is formed into an upper end of each of the pair of vertical legs so that the receptacle opens outwardly relative to the fascia plate. An insulating foam is bonded to the fascia plate and to a liner plate that has a tongue and groove formed on opposite edges of the liner plate.

In certain embodiments, a roof system comprises a plurality of roof panels that are formed from a fascia plate and a liner plate bonded to an insulating foam. The fascia plate has a pair of vertical legs extending from opposite edges of the fascia plate and the liner plate has a tongue and groove formed on opposite edges of the liner plate. The roof system also comprises a plurality of clips that are disposed between two adjacent roof panels and include one or more upper flanges that engage receptacles formed into an upper end of each of the vertical legs of the two adjacent roof panels. The roof system also comprises a batten disposed over the upper flanges and receptacles that maintains the engagement of the upper flanges and the receptacles. In certain embodiments, the roof system comprises a sealant applied between the batten and the receptacles. In certain embodiments, the roof system comprises a plurality of fasteners, wherein each fastener is disposed through a clip and the tongue of the liner plate and is coupled to a structure.

In certain embodiments, the fascia plate or the liner plate includes profiled portions. In certain embodiments, the insulating foam comprises a rigid thermal insulation. In certain embodiments, the roof panel has a thickness between 2.0 and 6.0 inches. In certain embodiments, the fascia plate and the liner plate each have a thickness between 26-ga. (0.0185 in.) and 22-ga. (0.0296 in.).

In certain embodiments a method of assembling a roof comprises constructing a plurality of roof panels formed from a fascia plate and a liner plate bonded to an insulating foam. Each fascia plate has a pair of vertical legs extending from opposite edges of the fascia plate. Each liner plate has a tongue and groove formed on opposite edges of the liner plate. A first roof panel is disposed on a roof support structure. A clip is disposed on the first roof panel so that a base flange of the clip rests on the tongue, a vertical leg of the clip is substantially parallel with one of the vertical legs of the fascia plate, and a first upper flange of clip is disposed within a receptacle on one of the vertical legs of the fascia plate. A fastener is disposed through the base flange of the clip and the tongue of the liner plate into the roof structure. A second roof panel is slid horizontally into engagement with the first roof panel so that the groove on the liner plate of the second roof panel is engaged with the tongue on the liner plate of the first roof panel and a receptacle on a vertical leg of the fascia plate of the second roof panel is engaged with a second upper flange of the clip. A batten is disposed over the receptacles of the first and second roof panels and coupled to the receptacles so as to maintain engagement of the receptacles with the first and second upper flanges of the clip.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
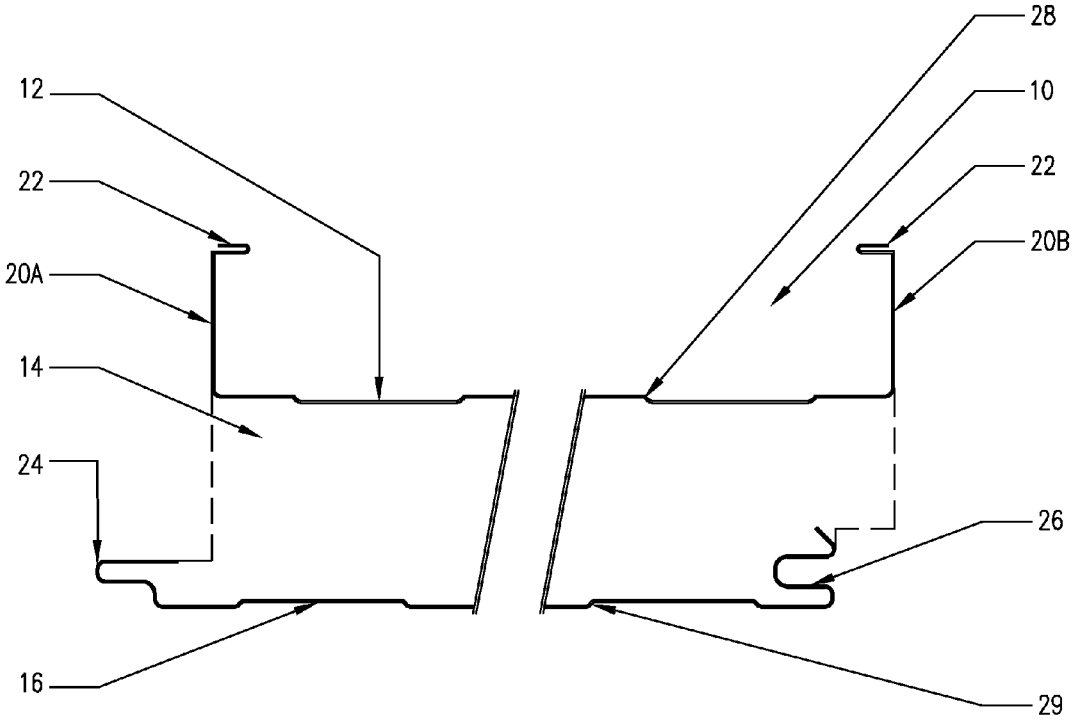
FIG. 1 is a partial sectional view of a roof panel.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a roof panel 10 includes fascia plate 12, insulating foam 14, and liner plate 16. Fascia plate 12 may be a sheet metal that is formed to include a pair of vertical legs 20A, 20B that project upward from opposite edges of the fascia plate 12. The upper end of each vertical leg 20A, 20B is formed into a U-shaped receptacle 22 that opens outwardly relative to the fascia plate 12. Liner plate 16 may be a sheet metal formed to include tongue 24 and corresponding groove 26 on opposite edges of the liner plate 16. Each of fascia plate 12 and liner plate 16 may be between 22-26 gauge galvanized steel (0.03 to 0.018 inches thick), or other metal material. Fascia plate 12 and liner plate 16 may also have varying profiled portions 28 that strengthen and/or add visual interest to the upper and lower surfaces of the roof panel 10.

Insulating foam 14 is bonded to the fascia plate 12 and liner plate 16 so that roof panel 10 forms an integrated assembly. Insulating foam 14 may be foamed-in-place isocyanurate foam, polyisocyanurate foam, polyurethane foam, or other rigid thermal insulation. Each roof panel 10 may be between about 2.0 and about 6.0 inches thick, have a width between about 36 inches and about 42 inches, and a length between about 8 and about 55 feet.

Figure 2:
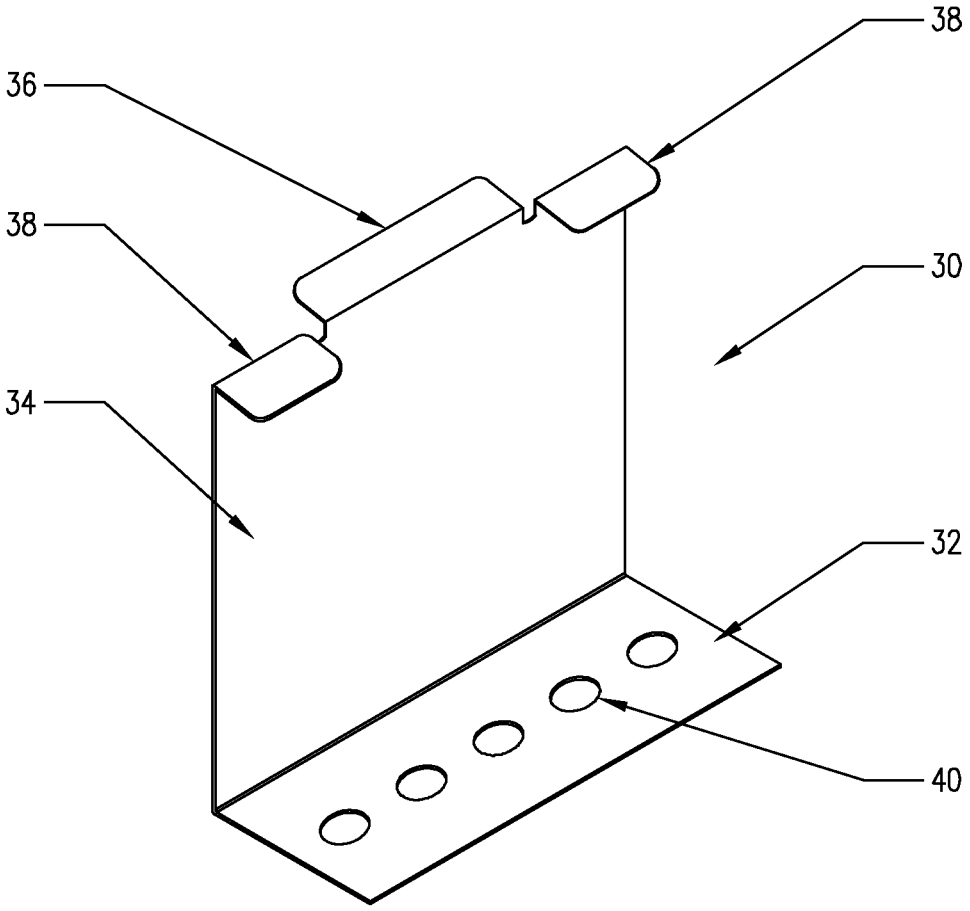
FIG. 2 is an isometric view of a panel clip.

FIG. 2 shows a clip 30 that is used to fasten the roof panel 10 of FIG. 1 to a structure. Clip 30 includes a base flange 32, vertical leg 34, first upper flange 36, and second upper flange 38. Base flange 32 includes a plurality of holes 40 to enable the clip 30 to be fastened to a roof structure with bolts, screws, or other fasteners. Upper flanges 36 and 38 are formed substantially perpendicular to the vertical leg 34 and arranged such that the first upper flange 36 extends from the vertical leg 34 opposite of the second upper flanges 38. Each roof panel 10 may be coupled to a structure by a plurality of clips 30 as needed for the particular design.

Figure 3:
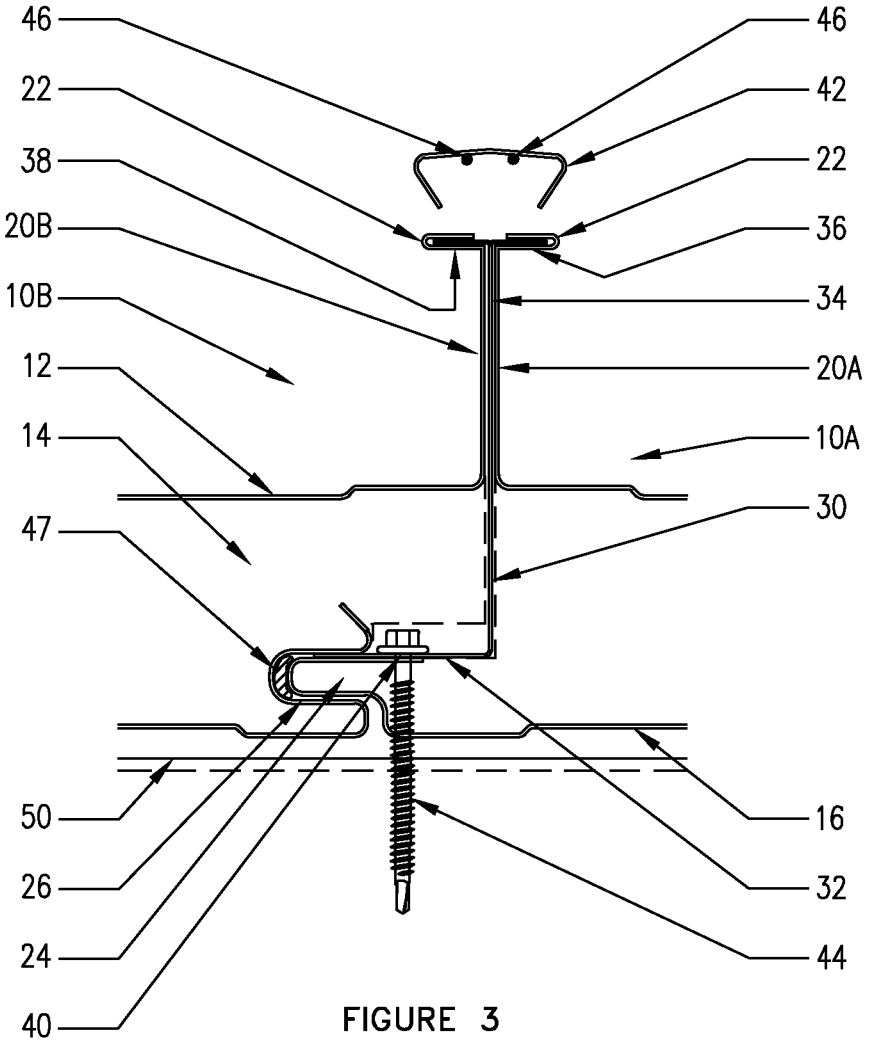
FIG. 3 is a partial sectional exploded view of a seam assembly.
Figure 4:
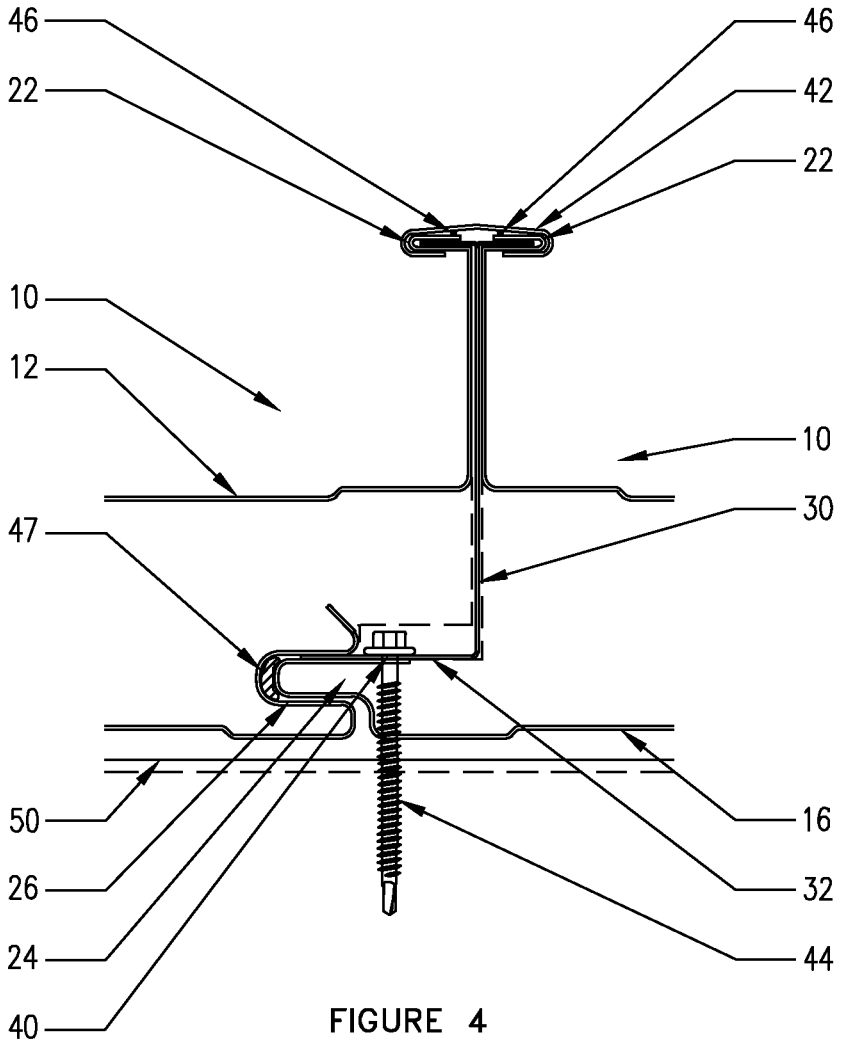
FIG. 4 is a partial sectional view of a seam assembly.

Referring now to FIGS. 3 and 4, roof panels 10 are installed by placing a first roof panel 10A onto a roof support structure 50. A clip 30 is placed on the first roof panel 10A so that the base flange 32 rests on tongue 24, the vertical leg 34 is parallel with the vertical leg 20A and the first upper flange 36 is disposed within the receptacle 22. Fastener 44 is inserted through hole 40 on the clip 30 and couples the first roof panel 10A to the roof support structure 50. Once the first roof panel 10A is coupled to the roof support structure 50, the second roof panel 10B is slid horizontally into place so that groove 26 engages tongue 24 and the second upper flange 38 is disposed within the groove 22 on the second roof panel 10B. The substantially horizontal engagement of receptacles 22 and clip 30 and tongue 24 and groove 26 allows the second roof panel 10B to be aligned with the first roof panel 10A by simply sliding the second roof panel 10B horizontally into place. Because the tongue 24 and groove 26 and receptacles 22 and clip 30 can be engaged without rolling or lifting the second roof panel 10B, assembly of the roof panels is quicker and safer than existing designs. In certain embodiments, a non-skinning butyl caulk seal 47, or other sealing material, may be added to the tongue 24 and/or groove 26 before engagement.

Once the roof panels 10A, 10B are aligned, a sealant 46 may be applied to the upper end of clip 30 and/or the receptacles 22 of the roof panels 10A and 10B. Sealant 46 may be hot-melt mastic or other appropriate sealing material. A batten 42, or cap member, is disposed over the engaged receptacles 22 and upper flanges 36, 38 of the clip 30. The ends of batten 42 are mechanically rolled around the outer surface of the receptacles 22 so as to secure the receptacles 22 to the clip 30. The combination of the sealed batten 42 and the sealed engagement of tongue 24 and groove 26 provides a substantially superior and uninterrupted air and water tight joint between adjacent roof panels 10A and 10B.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A roof system comprising:

a plurality of roof panels, wherein each roof panel is formed from a fascia plate and a liner plate bonded to an insulating foam, wherein the fascia plate has a pair of vertical legs extending from opposite edges of the fascia plate and the liner plate has a tongue and groove formed on opposite edges of the liner plate, wherein each vertical leg of the fascia plate has a u-shaped receptacle formed into an upper end thereof and opening outward relative to the fascia plate;

a plurality of clips that are disposed between two adjacent roof panels, wherein each of the plurality of clips has a base flange extending perpendicularly from a lower end of a clip leg, a first upper flange extending perpendicularly from an upper end of the clip leg, and a second upper flange extending perpendicularly from the upper end of the clip leg opposite the first upper flange, wherein the base flange of each clip is disposed on the tongue of the liner plate and the clip leg of each clip is parallel with the vertical leg of the fascia plate; and wherein the first and second upper flanges of each clip are engaged with the u-shaped receptacles of two adjacent roof panels; and a batten disposed over the first and second upper flanges and the receptacles so as to maintain the engagement of the upper flanges and the receptacles.

2. The roof system of claim 1, further comprising a sealant applied between the batten and the receptacles.

3. The roof system of claim 1, further comprising a plurality of fasteners, wherein each fastener is disposed through the base flange of one of the plurality of clips and the tongue of the liner plate and is coupled to a structure.

4. The roof system of claim 1, wherein the fascia plate or the liner plate includes profiled portions.

5. The roof system of claim 1, wherein the insulating foam comprises a rigid thermal insulation.

6. The roof system of claim 1, wherein the roof panel has a thickness between 2.0 and 6.0 inches.

7. The roof system of claim 1, wherein the fascia plate and the liner plate each have a thickness between 26-ga. (0.0185 inches) and 22-ga. (0.0296 inches).

8. A method of assembling a roof comprising:

constructing a plurality of roof panels, wherein each roof panel is formed from a fascia plate and a liner plate bonded to an insulating foam, wherein the fascia plate has a pair of vertical legs extending from opposite edges of the fascia plate and the liner plate has a tongue and groove formed on opposite edges of the liner plate, wherein each vertical leg of the fascia plate has a u-shaped receptacle formed into an upper end thereof and opening outward relative to the fascia plate;

disposing a first roof panel on a roof support structure;

disposing a clip on the first roof panel, wherein the clip has a base flange extending perpendicularly from a lower end of a clip leg, a first upper flange extending perpendicularly from an upper end of the clip leg, and a second upper flange extending perpendicularly from the upper end of the clip leg opposite the first upper flange, so that the base flange of the clip rests on the tongue, the vertical leg of the clip is substantially parallel with one of the vertical legs of the fascia plate, and the first upper flange of the clip is disposed within an u-shaped receptacle on one of the vertical legs of the fascia plate;

disposing a fastener through the base flange of the clip and the tongue of the liner plate into the roof structure;

horizontally sliding a second roof panel into engagement with the first roof panel so that the groove on the liner plate of the second roof panel is engaged with the tongue on the liner plate of the first roof panel and an u-shaped receptacle on a vertical leg of the fascia plate of the second roof panel is engaged with the second upper flange of the clip;

disposing a batten over the u-shaped receptacles of the first and second roof panels; and coupling the batten to the u-shaped receptacles so as to maintain engagement of the receptacles with the first and second upper flanges of the clip.

9. The method of claim 8, further comprising applying a sealant between the batten and the receptacles.

10. The method of claim 8, wherein the fascia plate or the liner plate includes profiled portions.

11. The method of claim 8, wherein the insulating foam comprises a rigid thermal insulation.

12. The method of claim 8, wherein the roof panel has a thickness between 2.0 and 6.0 inches.

13. The method of claim 8, wherein the fascia plate and the liner plate each have a thickness between 26-ga. (0.0185 inches) and 22-ga. (0.0296 inches).

* * * * *